US005113714A

United States Patent [19]

Eklund et al.

[11] Patent Number: 5,113,714

[45] Date of Patent: May 19, 1992

[54] USER FRIENDLY JOYSTICK

[75] Inventors: Wayne D. Eklund, Edgewood; James J. Kerley, Greenbelt, both of Md.

[73] Assignee: The United States of America as represented by the Administrator of the National Aeronautics & Space Administration, Washington, D.C.

[21] Appl. No.: 657,790

[22] Filed: Feb. 20, 1991

[51] Int. Cl.[5] ..... G05G 9/00

[52] U.S. Cl. ..... 74/471 XY; 248/65; 248/68.1; 273/148 B; 338/128

[58] Field of Search ..... 74/471 XY; 273/148 B; 338/128; 248/65, 68.1

[56] References Cited

U.S. PATENT DOCUMENTS 3,369,785 2/1968 Moore ..... 248/68.1
3,599,915 8/1971 Soltysik ..... 248/68.1
4,027,547 6/1977 Rahman et al. ..... 74/471 XY
4,101,863 7/1978 Lewicki ..... 74/471 XY X
4,670,743 6/1987 Zemke ..... 74/471 XY X
4,795,856 1/1989 Farmer ..... 248/68.1 X
4,825,157 4/1989 Mikan ..... 324/208
4,946,421 8/1990 Kerley, Jr. ..... 464/56

*Primary Examiner*—Allan D. Herrmann
*Assistant Examiner*—David W. Laub
*Attorney, Agent, or Firm*—R. Dennis Marchant; Guy M. Miller; Paul S. Clohan, Jr.

[57] ABSTRACT

A joystick control device having a lower U-shaped bracket, an upper U-shaped bracket, a handle attached to the upper U-shaped bracket, with the upper U-shaped bracket connected to the lower U-shaped bracket by a compliant joint allowing six degrees of freedom for the joystick. The compliant joint consists of at least one cable segment affixed between the lower U-shaped bracket and the upper U-shaped bracket. At least one input device is located between the lower U-shaped bracket and the upper U-shaped bracket.

7 Claims, 6 Drawing Sheets

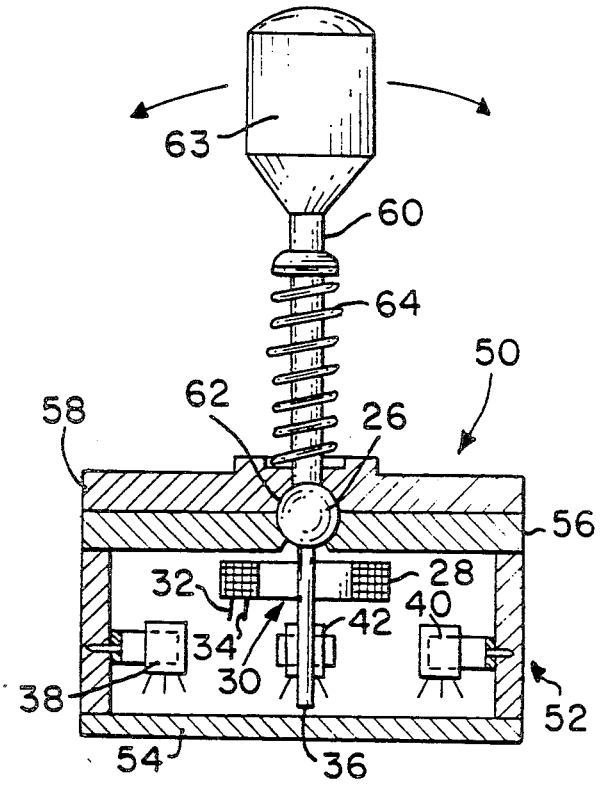
PRIOR ART
FIG. 1a
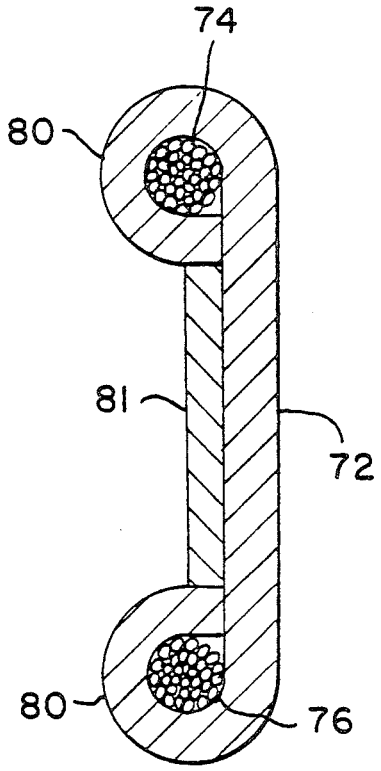
FIG. 7
PRIOR ART
FIG. 1b
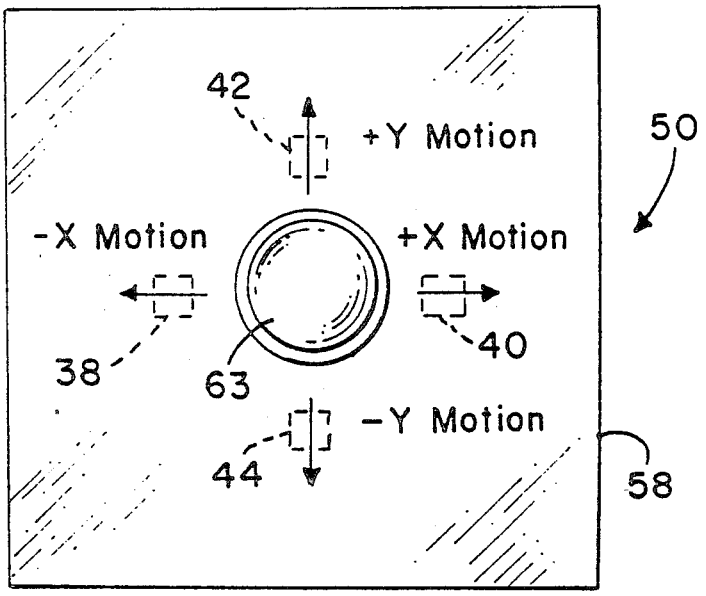

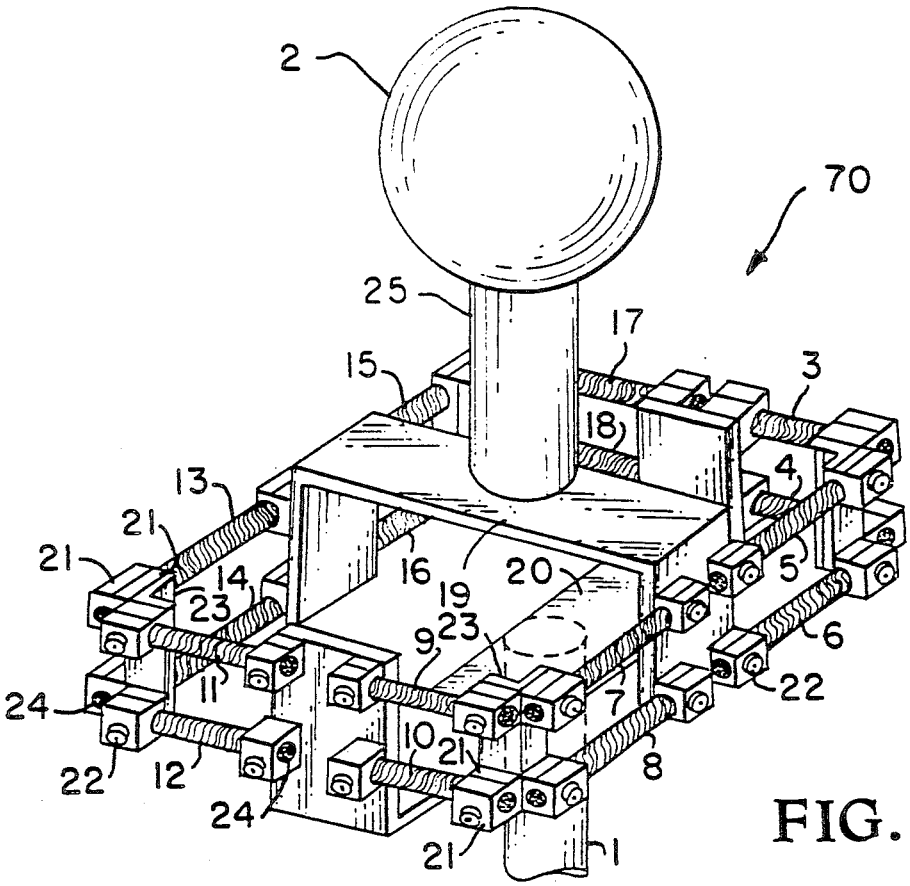
FIG. 2
FIG. 5
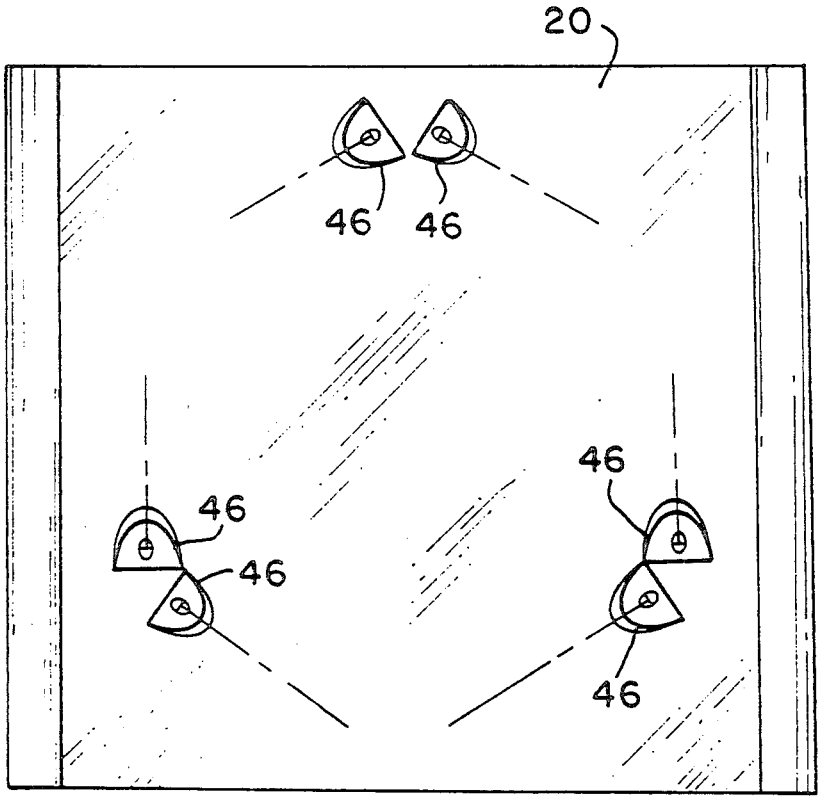

USER FRIENDLY JOYSTICK

ORIGIN OF THE INVENTION

The invention described herein was made in the performance of work under a NASA contract and by an employee of the United States Government and is subject to the provisions of Section 305 of the National Aeronautics and Space Act of 1958, Public Law 85-568 (72 Stat. 435; 42 U.S.C. §2457), and may be manufactured and used by or for the Government for governmental purposes without the payment of any royalties thereon or therefor.

TECHNICAL FIELD

This invention relates to joystick assemblies and, more particularly, to a joystick assembly that is user friendly in that it feels better to the user thus increasing his control and cuts down on his fatigue.

BACKGROUND ART

There are numerous hand operated controls known as "joysticks" available in the prior art. Joysticks have numerous applications not only in the intuitive electric control of moving bodies, such as cranes, small vehicles, remote handling apparatus, robots, and aircraft, but also in the control of the movements of particular dots or images appearing for example on the screen of a cathode ray tube such as in video games. In a typical joystick, the joystick shaft has a neutral position which is generally perpendicular to the plane of the switches or contacts and is moveable about the x-y axes to control the device it is attached to. Known joystick assemblies of this type have the joystick shaft pivotable about the point at which it passes through the top of a housing, with the lower end of the shaft making contact with contacts or switches in appropriate switching positions. By hand manipulation of the joystick, the operator selectively causes a specific contact to complete a circuit which in turn activates a specific operational control (i.e. left turns, right turns, reverse movement, forward movement, etc.) Most joysticks also have a means for returning the joystick to a neutral position, such as a spring or other resilient means. Their limitations, until now, were that they were either too "hard" or too "linear", that is, they did not reflect the natural reaction of the hand, the brain, and the feedback nature of man.

STATEMENT OF THE INVENTION

It is therefore an object of the present invention to provide a joystick with a non-linear motion in order to provide superior control and feedback to the operator.

It is also an object of the present invention to provide a joystick that reflects the natural reaction of the operators hand, his brain and the feedback nature of man.

It is a further object of the present invention to provide a joystick that will feel better to the user and thus increase his control and cut down on his fatigue.

The foregoing objects are achieved by providing a User Friendly Joystick having a support connected to a lower U-bracket and a handle with a knob on top connected to an upper U-bracket. Both the lower U-bracket and the upper U-bracket are "U" or "C" configuration brackets with "U" or "C" configuration cross-sections. These cross-sections are in different planes which are orthogonal with respect to each other. Four brackets or angles are suspended at the four corners of the joystick. Each one of the angles, as well as the upper U-bracket and lower U-bracket, include four cable end retainers. Each of the cable end retainers is provided with a bolt for fastening the retainers to an angle or bracket as well as applying pressure within the retainer to allow the retainer to act as a clamp, each of the retainers having a cylindrical bore. The bolts go through cable segments and the retainers and into the angles and brackets, with the retainers having separate halves. The retainer halves are configured so that they can be tightened down upon the cable segments and still maintain a gap. Adjacent end retainers, from angle to bracket and from bracket to angle are employed to clamp the cable segments, the cable segments being suitably stiff to maintain the joystick in an essentially box-like configuration. Each cable segment is provided with a copper swage at each end which extends, in essence, for the length of the cylindrical bore to provide a more secure clamp when the segment ends are placed into their respective cable end retainers.

It is the cable segments themselves, as well as their configuration, which are critical in terms of establishing the compliance characteristics of the pivot point of the joystick. The compliance of the pivot or joint may be varied by varying cable segment lengths and stranding, pre-twisting the cable, varying the spacing of the cable sets, the number of cable sets, the cable diameter, the cable material and angle between cable segments. As the operator moves the joystick handle, the cable compliant joint initially provides a low reaction force, but as the joystick handle is moved further in any direction, the reaction force becomes non-linearly greater until a limit is reached, either by providing a "stop" or reaching the limit of the compliant joint itself. It is also possible to provide internal vibrators within the knob on the joystick handle to measure the direction an intensity with which a robot controlled by the joystick moves into a target. The operator will then know when he has contacted his target, in what position he has contacted his target and the magnitude of force exerted on the target.

BRIEF DESCRIPTION OF THE DRAWINGS

FIG. 1*a* is a vertical section of a typical prior art joystick.

FIG. 1*b* is a top plan view of the prior art joystick of FIG. 1*a*.

FIG. 2 is a perspective view of a user friendly joystick according to the teachings of the present inventive concept.

FIG. 5 is a top view of the lower U-bracket showing six linear variable-displacement transformer mounting points.

FIG. 7 is a cross sectional view along lines 7—7 of FIG. 6.

DETAILED DESCRIPTION OF THE INVENTION

Figure 3:
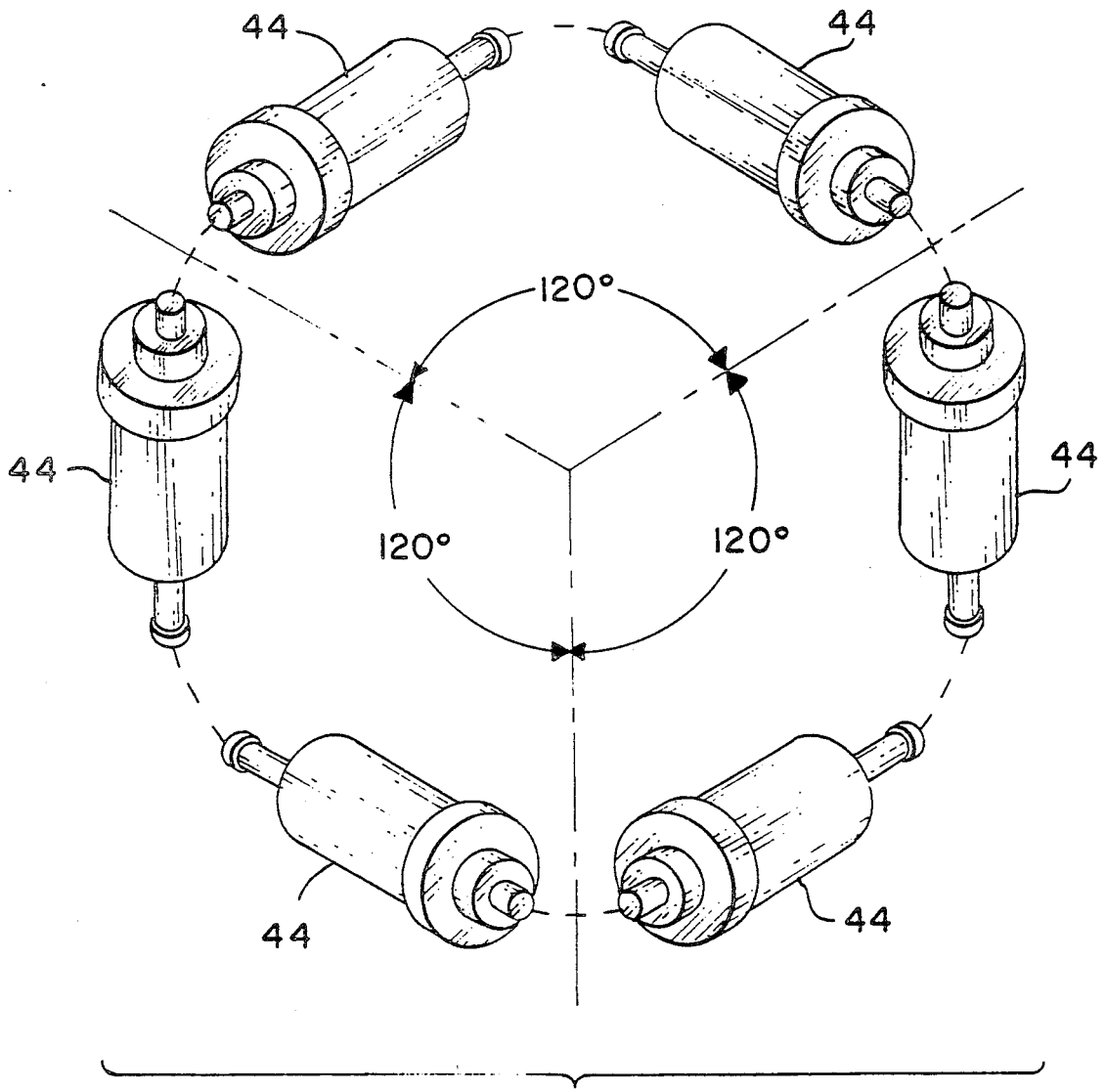
FIG. 3 is perspective view of six linear variable-displacement transformers that can provide output information in six degrees of freedom.

Referring now to FIGS. 1*a* and 1*b*, a typical prior art joystick is shown generally designated by the numeral 50, comprising a housing 52 having a base 54, and a bearing plate 58 for mounting a handle or actuator member 60. The cover 56 and bearing plate 58 each have a central aperture which forms part of a socket 62. The handle 60 has a manually-engageable knob 63, return spring 64, and a ball 26 which is held captive in the socket 62. The spring 64 maintains the handle 60 in a normal vertical or neutral position with respect to the base 54.

In this prior art joystick, there is mounted in the base 54 an electrical energizing coil 28 of doughnut-like configuration, having a central opening 30 and electrical leads 32, 34. The handle or actuator member 60 has a magnetic core 36 which extends through the central opening 30 of the coil 28. The core 36 can be constituted of any suitable magnetic material, such as iron or steel, alloys thereof, ferrite, or equivalents.

In this prior art device, there are four Hall-effect sensors 38, 40, 42, and 44 adjustably mounted in the base 54, in positions such that they are subjected to the magnetic field provided by the energizing coil 28 and the magnetic core 36. The Hall-effect sensors constitute magnetic-sensitive detector means. Three sensors 38, 40, and 42 are shown in FIG. 1*a*, whereas all four sensors 38, 40, 42, and 44 are shown in FIG. 1*b*.

The basic concept of the present invention is shown in FIG. 2, where the User Friendly Joystick is designated generally by numeral 70. Support 1, which is rigidly affixed to a suitable surface, is connected to a lower U-bracket 20 while handle 25 with attached knob 2 is connected to an upper U-bracket 19. Both the lower U-bracket 20 and the upper U-bracket 19 are "U" or "C" configuration brackets with "U" or "C" configuration cross-sections. These cross-sections are in different planes which are orthogonal with respect to each other. Four brackets or angles 23 are suspended at the four corners of joystick 70. Each one of the angles 23, as well as upper U-bracket 19 and lower U-bracket 20, include four cable end retainers 21. Each of the cable end retainers is provided with a bolt 22 for fastening the retainers to an angle or bracket as well as applying pressure within the retainer to allow the retainer to act as a clamp, each of the retainers having a cylindrical bore. In FIG. 2, the bolts go through the cable segments and the retainers and into the angles and brackets, with the retainers having separate halves. The retainer halves are configured so that they can be tightened down upon the cable segments and still maintain a gap. Adjacent end retainers, from angle to bracket and from bracket to angle are employed to clamp cable segments 3 through 18, the cable segments being suitably stiff to maintain the joystick 70 in an essentially "box-like" configuration. Each cable segment is provided with a copper swage 24 at each end which extends, in essence, for the length of the cylindrical bore to provide a more secure clamp when the segment ends are placed into their respective cable end retainers 21.

It is the cable segments themselves, as well as their configuration, which are critical in terms of establishing the compliance characteristics of the pivotal joint of joystick 70. This type of compliant joint allows joystick 70 to have six degrees of freedom. The compliance of the pivotal joint may be varied by varying cable segment lengths and stranding, pre-twisting the cable, varying the spacing of the cable sets, the number of cable sets, the cable diameter, the cable material and angle between cable segments. A detailed discussion of the cables, swaging, four cable set-up configurations, configuration angles, and the degrees of freedom available can be found in my patent entitled "Robot Cable-Compliant Devices", U.S. Pat. No. 4,946,421 dated Aug. 7, 1990, which is hereby incorporated by reference.

Figure 4:
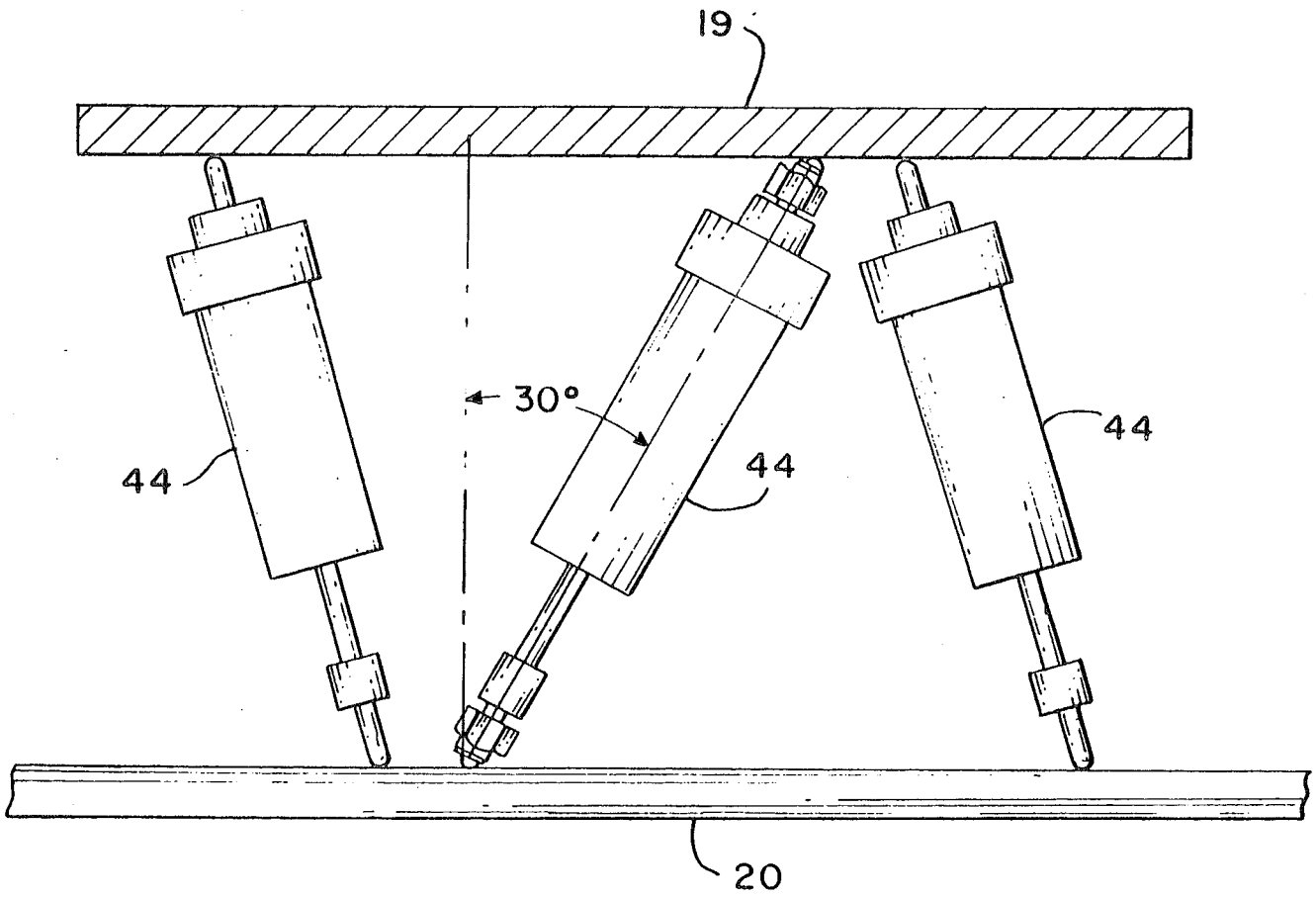
FIG. 4 is a side view showing the orientation of three linear variable-displacement transformers.

Thus the basic principal of the present invention has been described above. I will now describe a particular embodiment of the User Friendly Joystick that has application in the control of robotic devices. Shown in FIG. 3 is a perspective view of six Linear Variable-Displacement Transformers (LVDT) 44. This particular arrangement will provide positional information in six degrees of freedom; i.e., when mounted between the upper and lower U-brackets, they will act as input devices when the user moves the handle of the joy stick. Upper U-bracket 19 and lower U-bracket 20 will, of course, be made wider than depicted in FIG. 2 in order to accommodate the six LVDT's. FIG. 4 shows a side view of the upper U-bracket 19 and lower U-bracket 20 with three of the LVDT's 44 mounted between. The LVDT's are inclined at an angle of 30° as shown. FIG. 5 shows a top view of the lower U-bracket 20 with six LVDT mounts 46 positioned so as to place the LVDT's in the proper orientation as depicted in FIG. 3. Those skilled in the art will recognize that LVDT's are well known and require no further discussion here. What is unique is their placement and use with the current inventive techniques. Those skilled in the art will also recognize that the present invention is not limited to LVDT input devices but may be used with any known input devices.

Figure 6:
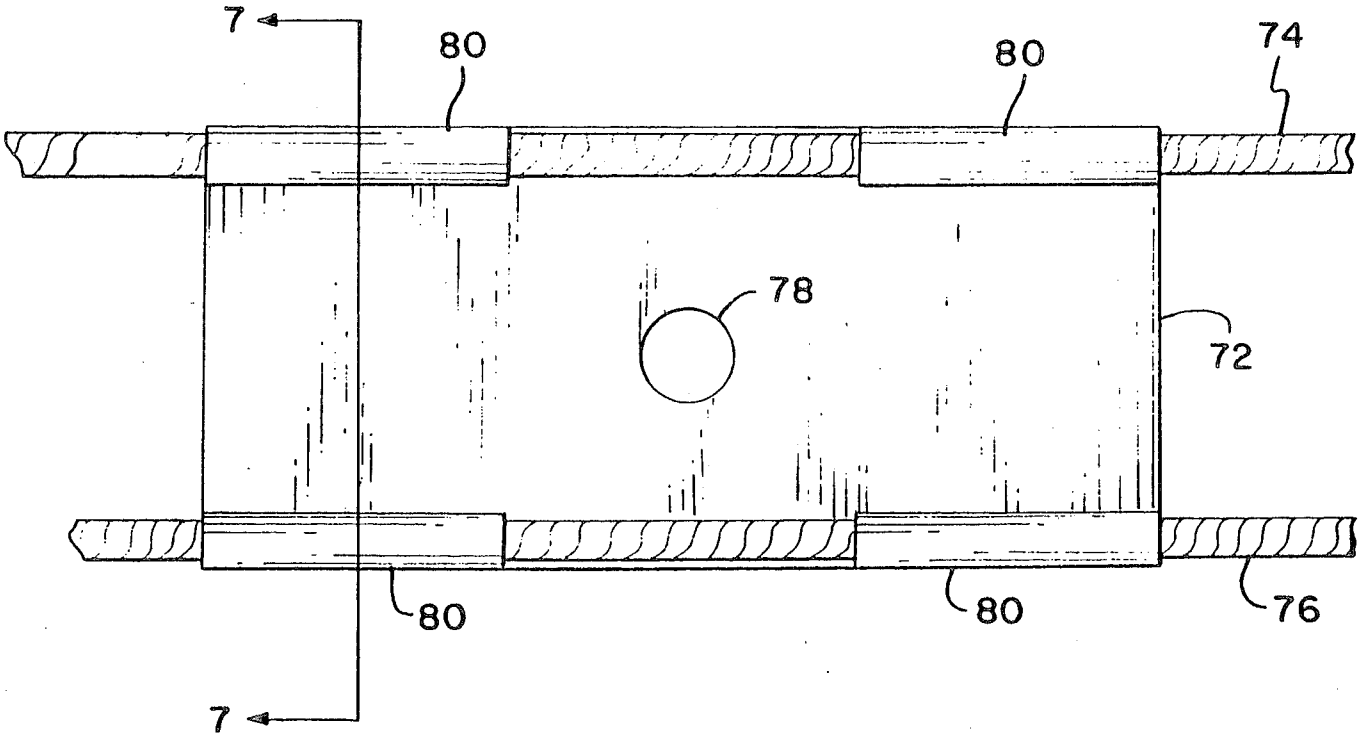
FIG. 6 is a front view of an alternate method of retaining the cables between the upper and lower U-brackets.
Figure 8:
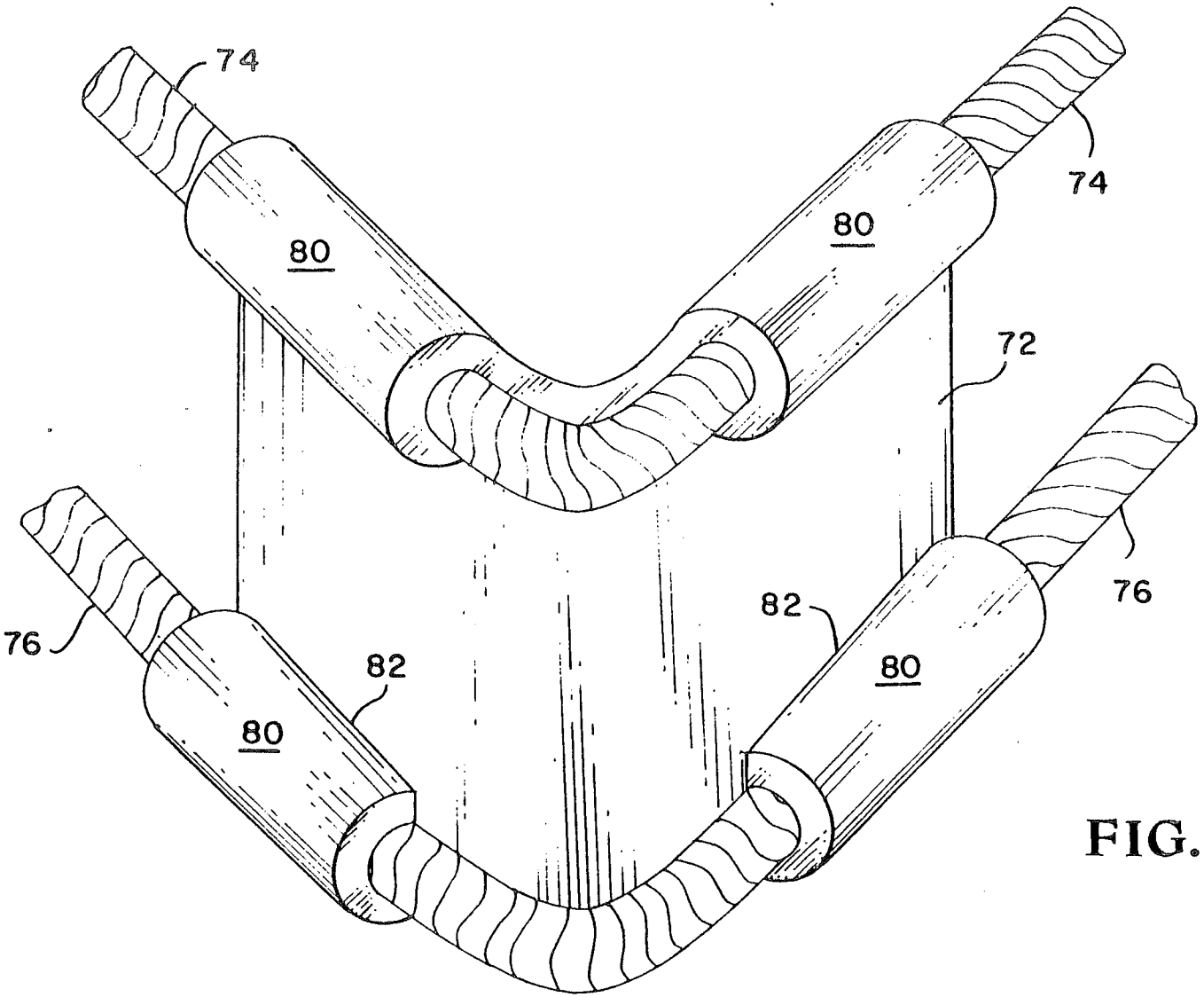
FIG. 8 is a perspective of an alternate method of retaining the cables at the corners between the upper and lower U-brackets.

An alternate method of retaining the cables that form the compliant joint between the upper and lower U-brackets is shown in FIG. 6. The use of this method eliminates copper swage 24, bolt 22, cable end retainer 21 and angle 23. It also reduces the number of cable segments from 16 to 2. Although two cable segments are shown, one cable segment could be used if the reaction characteristics of one cable segment is acceptable to the user. For straight-through retention of the cables, a "flat" cable retaining bracket 72 is used. This "flat" bracket would be used to secure the cables to the U-brackets. An aperture 78 is provided to bolt bracket 72 to either the upper or lower U-bracket. The cable retaining bracket is made from a soft material, such as copper or aluminum, so that bracket material 80 can be "rolled" over cable 74 and cable 76 to secure these cables. This is shown more clearly in FIG. 7 which shows a cross section of bracket 72 along line 7—7 of FIG. 6. As shown in FIG. 7, material 80 is "rolled" around cable 74 and cable 76 tightly to secure each cable to bracket 72. The technique of rolling the soft cable retaining bracket material around cable 74 and 76 generally requires a three step method. A steel insert having a thickness approximately the same as the diameter of cable 74 and 76 is placed on bracket 72 and material 80 is rolled 180° around the steel insert. The steel insert is removed and replaced by two steel rods of slightly greater diameter than cable 74 and 76. Material 80 is then rolled an additional 90° around the steel rods. Cable 74 and 76 is then threaded through the opening in material 80 left after the removal of the steel rods and the final swage of material 80 is done with a special pair of swaging pliers. As a final security measure, material 81 is inserted between cable 74 and cable 76, as shown in FIG. 7, or material 80 is soldered to bracket 72 along joint 82, as shown in FIG. 8. At the corners of joystick 70, bracket 72 is bent 90°, also as shown in FIG. 8. In this application, aperture 78 is not needed. This method of cable retention is inexpensive, reliable and faster to fabricate than the prior art techniques and will prove superior in this application.

I have described above a joystick that is superior in all aspects to the prior art. Thus as the operator grabs knob 2 and moves handle 25, the cable compliant joint shown in FIG. 2 initially provides a low reaction force, but as handle 25 is moved further in any direction, the reaction force provided by the compliant joint becomes non-linearly greater until a limit is reached, either by providing a "stop" or reaching the limit of the compliant joint itself. It is also possible to provide internal vibrators within knob 2 to measure the direction and intensity with which a robot controlled by joystick 70 moves into a target. The operator will then know when he has contacted his target, in what position he has contacted his target and the magnitude of force exerted on the target.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A joystick control device comprising:

a lower U-shaped bracket;

an upper U-shaped bracket;

a handle affixed to said upper U-shaped bracket;

said upper U-shaped bracket connected to said lower U-shaped bracket by a compliant joint allowing six degrees of freedom for said joystick;

said compliant joint comprising at least one cable segment affixed between said lower U-shaped bracket and said upper U-shaped bracket; and at least one input device located between said lower U-shaped bracket and said upper U-shaped bracket.

2. The device of claim 1 wherein said compliant joint comprises two cable segments.

3. The device of claim 2 wherein said cable segments are held at a fixed vertical distance by eight cable retaining brackets, each of said cable retaining brackets having a portion of material rolled over a part of said cable segment to secure said cable segment to said cable retaining bracket, said upper U-shaped bracket having a cable retaining bracket affixed at either end, said lower U-shaped bracket having a cable retaining bracket affixed at either end, and the remaining four cable retaining brackets bent 90° and circumferentially interposed between the adjacent ends of said U-shaped brackets thereby forming four corners on said cable segments.

4. A joystick control device comprising:

a plurality of brackets, two of said brackets having an essentially "U" configuration cross-section, the other of said brackets being angle brackets, said two U-shaped brackets having their said "U" configuration cross-sections in substantially different orthogonal planes;

a handle affixed to one of said U-shaped brackets;

a plurality of cable segments, said segments having longitudinal axes which lie substantially in at least two planes, all of said at least two planes being orthogonal to said planes of said "U" cross-sections of said two U-shaped brackets and generally perpendicular to said handle longitudinal axis, all of said plurality of said brackets having means to retain said cable segments, wherein one end of each of said cable segments is secured to one of said angle brackets and the other end of each of said cable segments is secured to one of said two U-brackets, wherein said angle brackets are circumferentially interposed between the adjacent legs of said U-shaped brackets, and wherein said cable segments permit compliant movement of said handle of said joystick; and at least one input device located between said two U-shaped brackets.

5. The device of claim 4 wherein each of said planes in which said cable segments lie contain a plurality of segments, said plurality of cable segments in each of said planes in which said cable segments lie defining a cable segment set.

6. The device of claim 4 wherein said cable segments are provided with a swage at each end to provide a more secure clamp when said cable segment ends are placed into cable end retainers.

7. The device of claim 6 wherein said swage is a copper swage.

* * * * *